US011529747B1

(12) United States Patent
Zeng

(10) Patent No.: US 11,529,747 B1
(45) Date of Patent: Dec. 20, 2022

(54) BACK SHAVER

(71) Applicant: NATURE LAB CORPORATION, Aurora, CO (US)

(72) Inventor: Xianqin Zeng, Aurora, CO (US)

(73) Assignee: NATURE LAB CORPORATION, Aurora, CO (US)

( * ) Notice: Subject to any disclaimer, the term of this patent is extended or adjusted under 35 U.S.C. 154(b) by 0 days.

(21) Appl. No.: 17/751,887

(22) Filed: May 24, 2022

(51) Int. Cl.
*B26B 21/52* (2006.01)
*B26B 21/40* (2006.01)

(52) U.S. Cl.
CPC ..... *B26B 21/521* (2013.01); *B26B 21/4012* (2013.01); *B26B 21/4062* (2013.01); *B26B 21/522* (2013.01)

(58) Field of Classification Search
None
See application file for complete search history.

(56) References Cited

U.S. PATENT DOCUMENTS 4,970,784 A * 11/1990 Althaus ..... B26B 21/225 30/527
6,311,400 B1 * 11/2001 Hawes ..... B26B 21/225 30/527
9,937,629 B1 * 4/2018 Dryfhout ..... B26B 21/4031
11,345,056 B1 * 5/2022 Wang ..... B26B 21/14
2006/0283025 A1 * 12/2006 Follo ..... B26B 21/225 30/527
2012/0124840 A1 * 5/2012 Iaccarino ..... B26B 21/521 30/50
2012/0210586 A1 * 8/2012 Lelieveld ..... B26B 19/04 30/527

FOREIGN PATENT DOCUMENTS

CN 109015771 A * 12/2018

OTHER PUBLICATIONS

English translation of CN 109015771A, publication date Dec. 2018.*

* cited by examiner

*Primary Examiner* — Hwei-Siu C Payer
(74) *Attorney, Agent, or Firm* — Daniel M. Cohn; Howard M. Cohn

(57) ABSTRACT

A back shaver includes a cutter head assembly and a handle. The handle is connected to the cutter head assembly. The cutter head assembly includes cutter heads, a cutter head frame, and a connecting member. The cutter heads are embedded in a front surface of the cutter head frame. A back surface of the cutter head frame is connected to the connecting member through a rotating shaft. Elastic components are disposed on one side, distal from the handle, of the connecting member. Sliding blocks are disposed on the back surface of the cutter head frame. When the handle is operated, a first force moment is applied to the cutter head frame through the connecting member, and a free end of each of the elastic components slides along a first end of a corresponding one of the sliding blocks to a second end of the corresponding one of the sliding blocks.

10 Claims, 7 Drawing Sheets

BACK SHAVER

TECHNICAL FIELD

The present disclosure relates to a technical field of shavers, and in particular to a back shaver.

BACKGROUND

At present, back shavers on market are composed of a cutter head assembly and a handle, which is complex in structure, inconvenient to operate, and poor in experience effect. For example, when using conventional back shavers, if there is excessive force on the handle, the cutter head assembly may generate excessive force moment corresponding to the handle, so that a cutting edge surface of a cutter head applies an overweight load on human skins. However, if there is small force on the handle, the cutter head assembly may generate too small force moment corresponding to the handle, so that a cutting edge surface of the cutter head is slightly in contact with the human skins, which results that body hair is not shaved or there remains residual body hair on a skin surface.

SUMMARY

In order to solve problems that existing back shavers are complex in structure, inconvenient to operate, and poor in experience effect, when operating a handle, the handle applies force moment to a cutter head assembly, and a mechanism needs to be disposed on the cutter head assembly to generate counter force moment to achieve balance with the force moment. Then a cutter head surface of the cutter head assembly is gently rotated corresponding to the handle, so that the cutter head surface of the cutter head assembly is closely attached to a skin surface of a human body, which satisfies comfort and shaves body hair as cleanly as possible.

The present disclosure provides a back shaver, including a cutter head assembly and a handle. The handle is connected to the cutter head assembly. The cutter head assembly includes cutter heads, a cutter head frame, and a connecting member. The cutter heads are embedded in a front surface of the cutter head frame. A back surface of the cutter head frame is connected to the connecting member through a rotating shaft. Elastic components are disposed on one side, distal from the handle, of the connecting member. Sliding blocks are disposed on the back surface of the cutter head frame. When the handle is operated, a first force moment is applied to the cutter head frame through the connecting member, and a free end of each of the elastic components slides along a first end of a corresponding one of the sliding blocks to a second end of the corresponding one of the sliding blocks to generate a second force moment against the first force moment, so that the cutter head surface of the cutter head frame gently rotates corresponding to the handle, and closely contacts the skin surface.

Furthermore, each of the sliding blocks is an arc-shaped convex block, and each of the sliding blocks includes a first arc-shaped portion and a second arc-shaped portion. A first end of the first arc-shaped portion is close to an upper edge of the back surface of the cutter head frame, and a second end of the first arc-shaped portion is in a transitional connection with the second arc-shaped portion.

Furthermore, the second arc-shaped portion is in an arc-shaped structure, and the arc-shaped structure protrudes towards an outer side of the back surface of the cutter head frame.

Furthermore, a number of the sliding blocks is two, and a number of the elastic components corresponding to the sliding blocks is two.

Furthermore, each of the elastic components is an elastic sheet and is in an arc-shaped structure.

Furthermore, limiting grooves are defined on the back surface of the cutter head frame, limiting stop blocks are disposed on the connecting member, and the limiting stop blocks rotate in the limiting grooves, so that a relative rotation angle of the cutter head frame and the connecting member is not greater than 30°.

Furthermore, a number of the limiting grooves is two, and a number of the limiting stop blocks corresponding to the limiting grooves is two.

Furthermore, the limiting grooves and the limiting stop blocks are on a same axis.

Furthermore, a clamping groove is defined on a front end of the handle. A clamping hole is defined on a top of the front end of the handle, and the clamping hole is communicated with the clamping groove. An elastic member is disposed at one end, distal from the cutter head frame, of the connecting member. The elastic member is slidably inserted into the clamping groove. A button is disposed on a distal end of the elastic member, and the button is inserted into the clamping hole.

Furthermore, an arc-shaped groove is defined on one side, distal from a front end of the handle, of the clamping hole. An inclined surface configured to press a button is disposed at one end, close to the arc-shaped groove, of the button.

The back shaver of the present disclosure has following beneficial technical effects.

Through a way that the first force moment is applied to the cutter head frame through the connecting member, and the free end of each of the elastic components slides along the first end of the corresponding one of the sliding blocks to the second end of the corresponding one of the sliding blocks to generate the second force moment against the first force moment and reaches a balance, so that the cutter head surface of the cutter head frame gently rotates corresponding to the handle, and a cutting edge surface of the cutter head closely contacts and moves on the skin surface, thereby achieving a good shaving effect. The back shaver of the present disclosure is simple in design structure and conforms to ergonomics, which is convenient to operate.

BRIEF DESCRIPTION OF DRAWINGS

In order to more clearly illustrate technical solutions of embodiments of the present disclosure or prior art, accompanying drawings required in the embodiments or descriptions in the prior art are briefly described below. It should be apparent that the drawings in the following descriptions are merely some embodiments of the present disclosure, and for a person of ordinary skill in the art, other drawings may be obtained according to the drawings without creative efforts.

Figure 1:
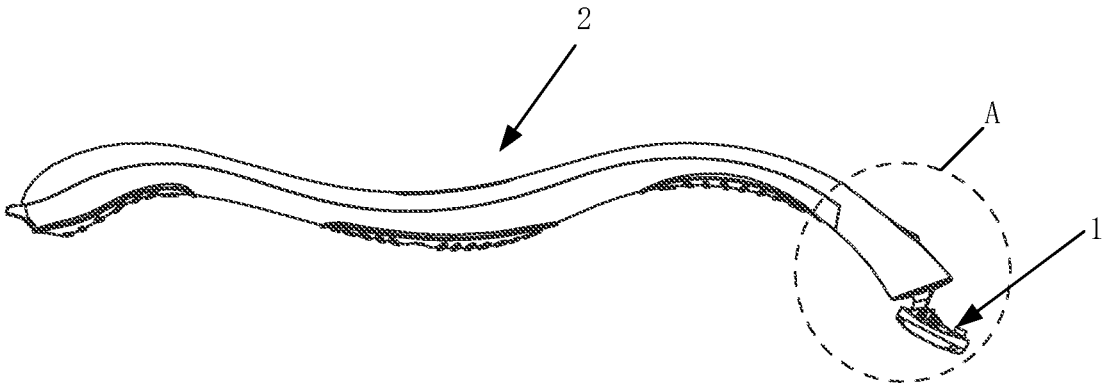
FIG. 1 is an overall structural schematic diagram of a back shaver according to one embodiment of the present disclosure.
Figure 2:
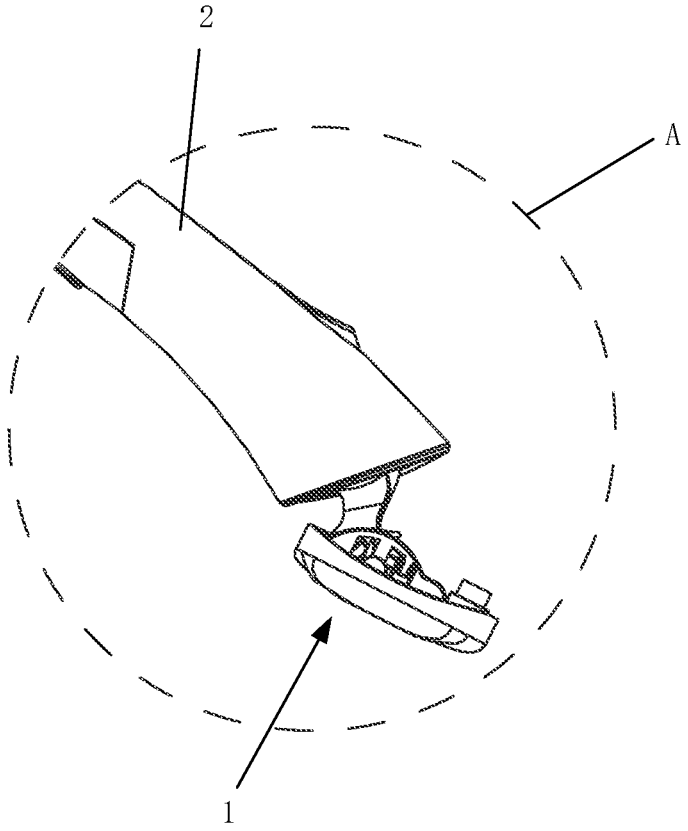
FIG. 2 is an enlarged schematic diagram of portion A shown in FIG. 1.
Figure 3:
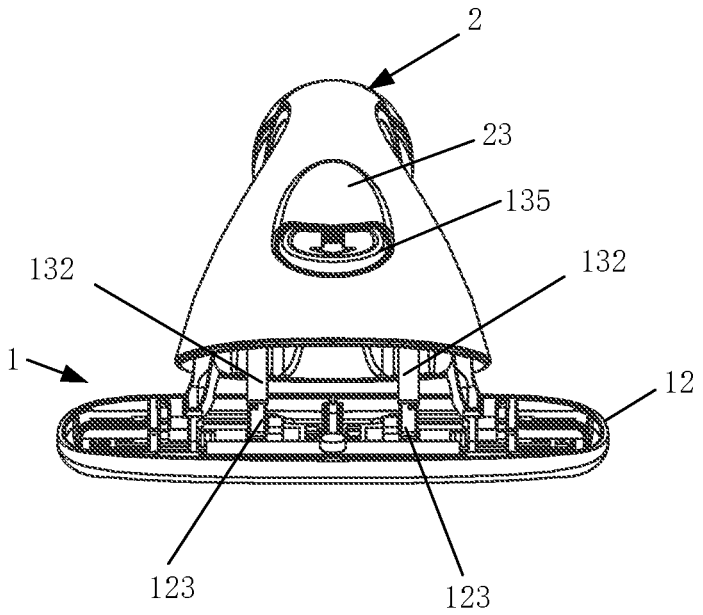
FIG. 3 is an overall structural schematic diagram of the back shaver presenting in another angle according to one embodiment of the present disclosure.
Figure 4:
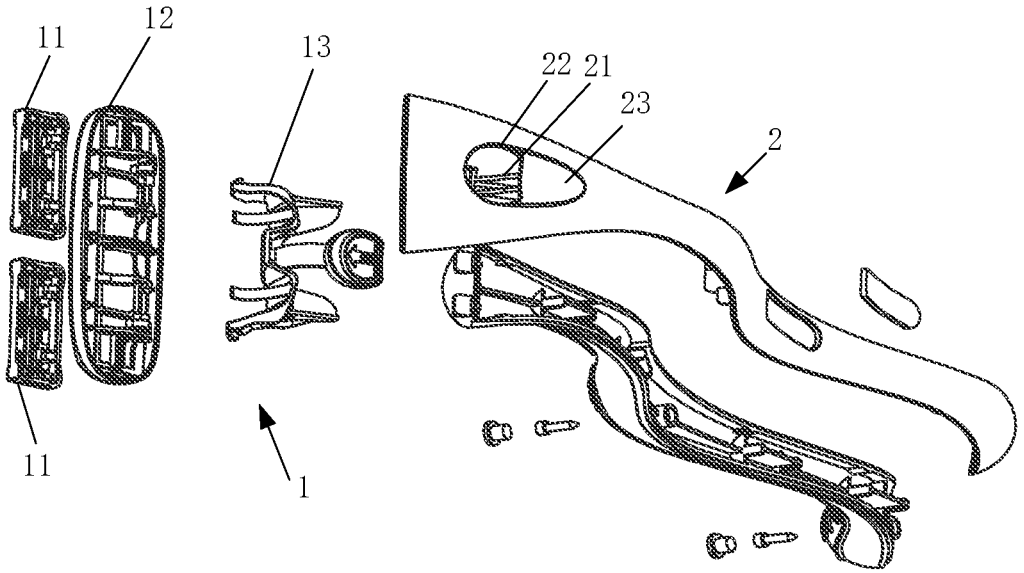
FIG. 4 is an exploded schematic diagram of the back shaver according to one embodiment of the present disclosure.
Figure 5:
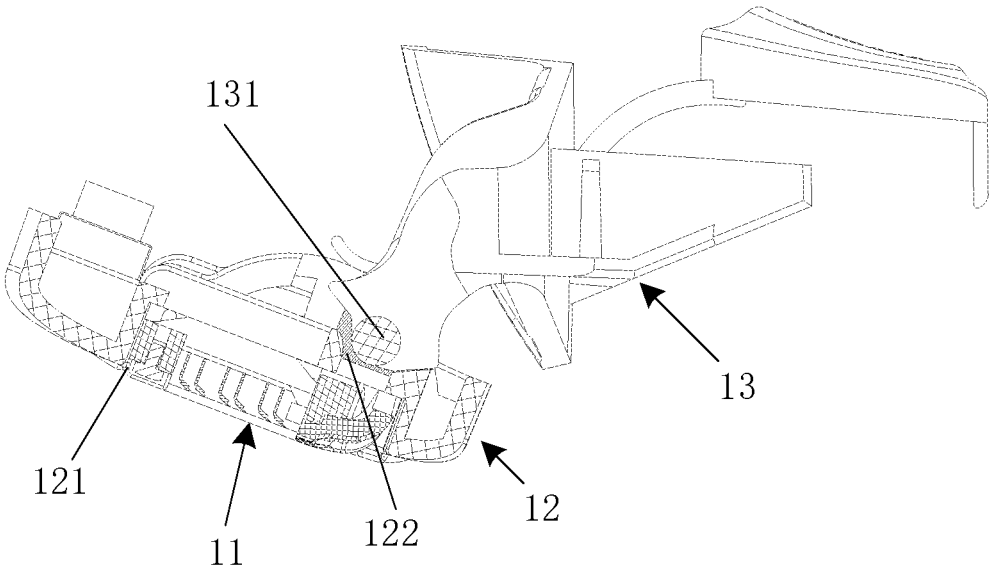
FIG. 5 is a cross-sectional schematic diagram of a cutter head assembly according to one embodiment of the present disclosure where the cutter head assembly is in an initial state.

Reference number in the drawings: 1. cutter head assembly; 11. cutter heads; 12. cutter head frame; 121. grooves; 122. shaft hole; 123. sliding blocks; 123*a*. first arc-shaped portion; 123*b*. second arc-shaped portion; 124. limiting grooves; 13. connecting member; 131. rotating shaft; 132. elastic components; 133. limiting stop blocks; 134. elastic member; 135. button; 135*a*. inclined surface; 2. handle; 21. clamping groove; 22. clamping hole; 23. arc-shaped groove.

DETAILED DESCRIPTION

Technical solutions in embodiments of the present disclosure are clearly and completely described below with reference to accompanying drawings in the embodiments of the present disclosure. Obviously, the described embodiments are only a part of the embodiments of the present disclosure, rather than all of the embodiments. All other embodiments obtained by a person of ordinary skill in art based on the embodiments of the present disclosure without creative efforts shall fall within a protection scope of the present disclosure.

It should be noted that terms "front", "rear", "left", "right", "upper" and "lower" used in descriptions below refer to directions in the drawings, and terms "inner" and "outer" refer to directions toward or away from a geometric center of a specific component, respectively.

Referring to FIGS. 1-11, a back shaver according to an embodiment of the present disclosure includes a cutter head assembly 1 and a handle 2, and the handle is connected to the cutter head assembly 1. The cutter head assembly 1 and the handle 2 are detachably connected, or the cutter head assembly 1 and the handle 2 are further integrally formed. The cutter head assembly 1 includes cutter heads 11, a cutter head frame 12, and a connecting member. Grooves 121 are defined in a front surface of the cutter head frame 12, and the cutter heads 11 are embedded in the grooves 121. Optionally, two grooves 121 are defined on the front surface of the cutter head frame 12, and the two parallel cutter heads 11 are disposed on the two parallel grooves 121. A shaft hole 122 is defined in each of two ends of a back surface of the cutter head frame 12. A rotating shaft 131 is disposed on each of two ends of the connecting member 13, and the rotating shaft 131 is rotatably connected to the shaft hole 122 of the cutter head frame 12. The rotating shaft 131 and the shaft hole 122 are on a same axis. The cutter head frame 12 rotates relative to the connecting member 13. Two elastic components 132 are disposed on one side, distal from the handle 2, of the connecting member 13. Each of the elastic components 132 has a same structure and is of an arc-shaped structure. Optionally, each of the elastic components 132 is an elastic sheet, and the elastic components 132 and the connecting member 13 are integrally formed. Sliding blocks 123 are disposed on the back surface of the cutter head frame 12, and each of the sliding blocks 123 is respective to each of the elastic components 132. When the connecting member 13 rotates with and the cutter head frame 12, a free end of each of the elastic components 132 slides relative to respective one of the sliding blocks 123.

When in use, the handle 2 is operated to exert a force between the cutter head frame 12 and the connecting member 13 to generate rotation force moment. The cutter head frame 12 and the connecting member 13 rotate relative to each other along the rotating shaft 131, so that blade surfaces of the cutter heads 11 of the cutter head frame 12 contact skin. While the cutter head frame 12 and the connecting member 13 rotate relatively, the free end of each of the elastic components 132 slides to one end of an arc bottom along one end of an arc top of each of the sliding blocks 123 to generate another force opposite to the force, so that the cutter head frame 12 is gently rotated relative to the connecting member 13, the blade surfaces of the cutter heads 11 are tightly attached to the skin along the undulating skin, and the blade surfaces of the cutter heads 11 smoothly close to the skin, thereby smoothly and reliably removing hair.

In the embodiment of the present disclosure, the number of the sliding blocks 123 on the back surface of the cutter head frame 12 is two, and the two sliding blocks 123 are identical in structure. The number of the elastic components 132 respective to the sliding blocks 123 is two. The free ends of the two elastic components 132 synchronously slide to the arc bottoms of the two sliding blocks 123 along the arc tops of the two sliding blocks 123, thereby increasing counter force generated through the force applied to the handle 2, improving stability of the cutter head frame 12 and the connecting member 13 relative to each other along the rotating shaft 131, and better realizing that the blade surfaces of the cutter heads 11 are smoothly in close contact with the skin, and the hair is removed smoothly and reliably.

In the embodiment of the present disclosure, each of the sliding blocks 123 is an arc-shaped convex block, including a first arc-shaped portion 123*a* and a second arc-shaped portion 123*b*. One end of the first arc-shaped portion 123*a* is close to an upper edge of the back surface of the cutter head frame 12, and the other end of the first arc-shaped portion 123*a* is in a transitional connection with one end of the second arc-shaped portion 123*b*. The other end of the second arc-shaped portion 123*b* is close to a lower edge of the back surface of the cutter head frame 12. The second arc-shaped portion 123*b* is of an arc-shaped structure, and the arc-shaped structure protrudes towards an outer side of the back surface of the cutter head frame 12. Optionally, the sliding blocks 123 and the cutter head frame 12 are integrally formed, which is convenient for processing.

Optionally, a limiting groove 124 is respectively defined on two portions of the back surface of the cutter head frame 12, limiting stop blocks 133 are disposed on the connecting member 13, and the limiting stop blocks 133 rotate relatively in the limiting grooves 124, so that a relative rotation angle of the cutter head frame 12 and the connecting member 13 is not greater than 30°. The limiting grooves 124, the limiting stop blocks 133, a central shaft of the rotating shaft 131, and a central shaft of the shaft hole 122 are on a same axis.

Figure 12:
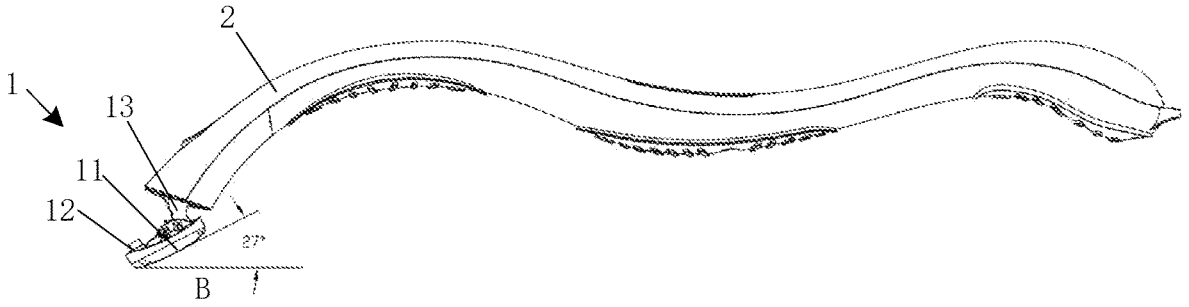
FIG. 12 is a schematic diagram of the back shaver according to an embodiment of the present disclosure where the back shaver is in an initial state.

As shown in FIG. 12, in an initial original state of the back shaver of the present disclosure, an upper edge of the front surface of the cutter head frame 12 is in contact with skin B (the skin B is regarded as a horizontal state). At this time, the handle 2 does not apply the force to the cutter head assembly 1, and the angle between a plane where the cutter heads 11 are located and the skin B is 27°.

Figure 13:
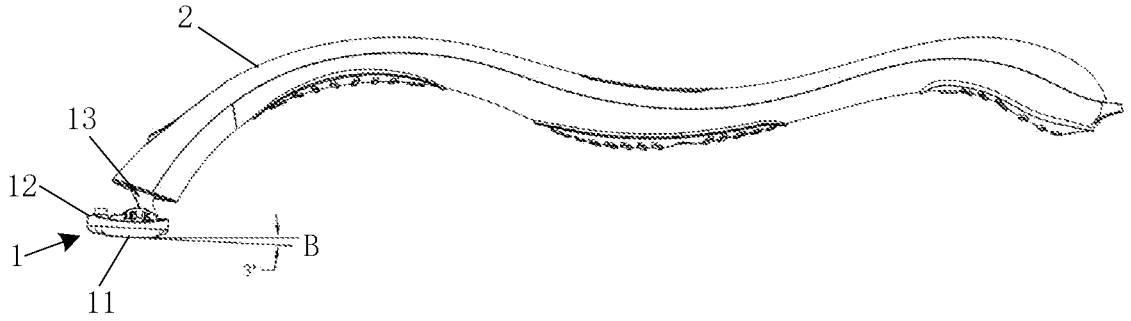
FIG. 13 is a schematic diagram of the back shaver according to an embodiment of the present disclosure where the back shaver is in a using state.

As shown in FIG. 13, when in use, the handle 2 applies a force to the cutter head frame 12, so that the cutter head frame 12 and the connecting member 13 rotate relative to each other and generate the rotation force moment. Taking the upper edge of the cutter head frame 12 as a rotation axis, the cutter head frame 12 rotates in a direction of the skin B. After the plane where the cutter heads 11 on the front surface of the cutter head frame 12 is in close contact with the skin B, continue to rotate, and the cutter heads 11 on the front surface of the cutter head frame 12 are recessed 3° below the skin B, so that the blade surfaces of the cutter heads 11 are completely in contact with the skin B.

Figure 6:
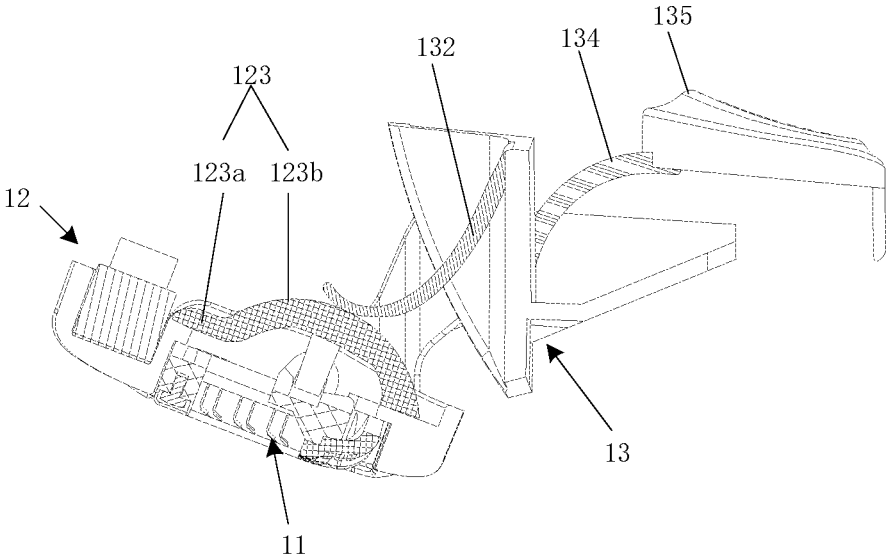
FIG. 6 is another cross-sectional schematic diagram of the cutter head assembly according to one embodiment of the present disclosure where the cutter head assembly is in an initial state.
Figure 7:
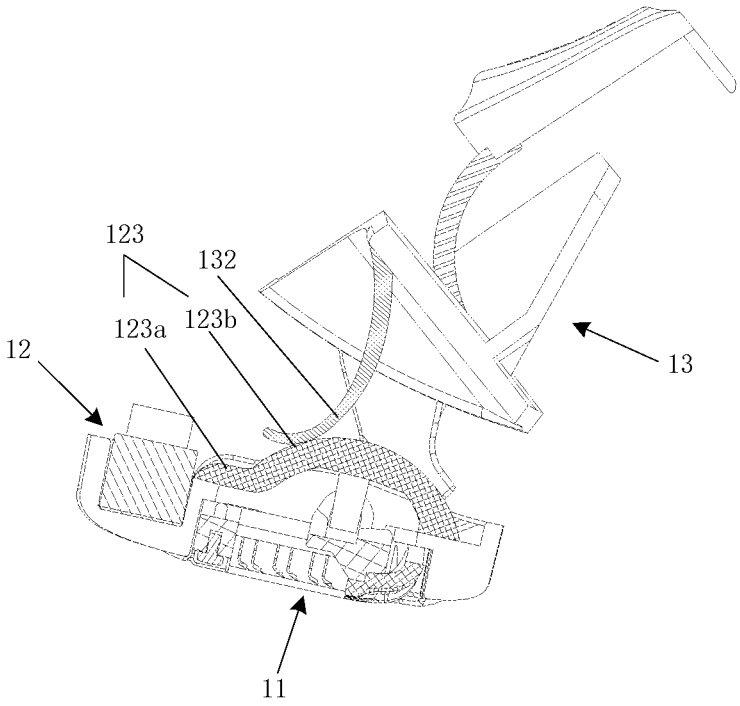
FIG. 7 is a cross-sectional schematic diagram of the cutter head assembly according to one embodiment of the present disclosure where the cutter head assembly is in a using state.
Figure 8:
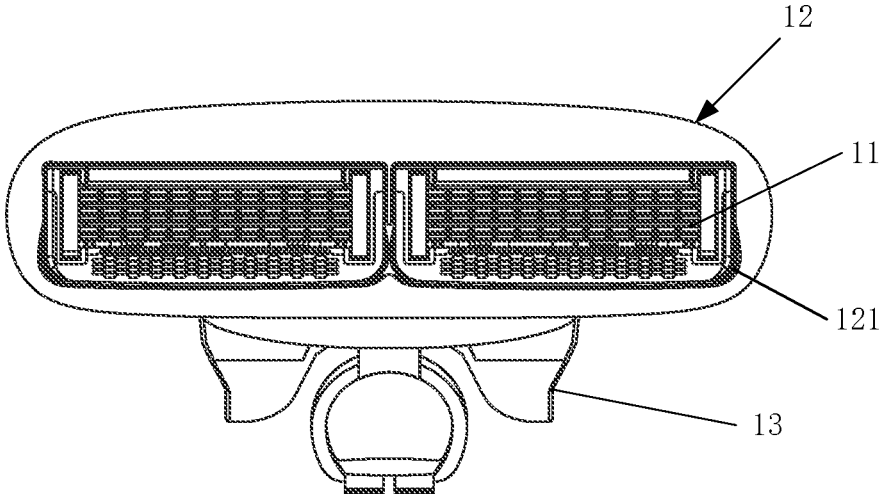
FIG. 8 is a structural schematic diagram of the cutter head assembly according to one embodiment of the present disclosure.
Figure 9:
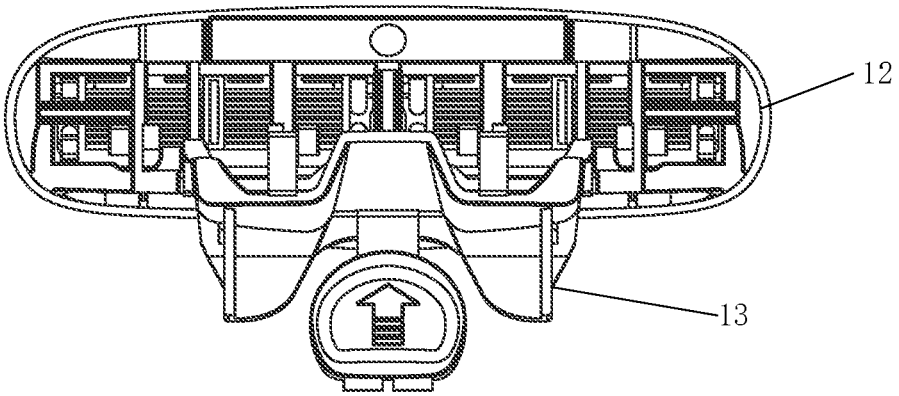
FIG. 9 is a structural schematic diagram of the cutter head assembly presenting in another angle according to one embodiment of the present disclosure.
Figure 10:
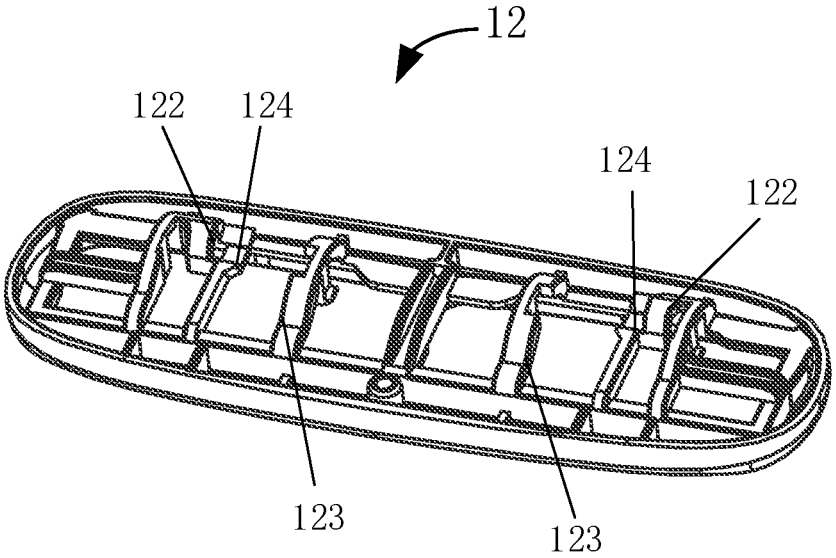
FIG. 10 is a structural schematic diagram of a cutter head frame according to one embodiment of the present disclosure.
Figure 11:
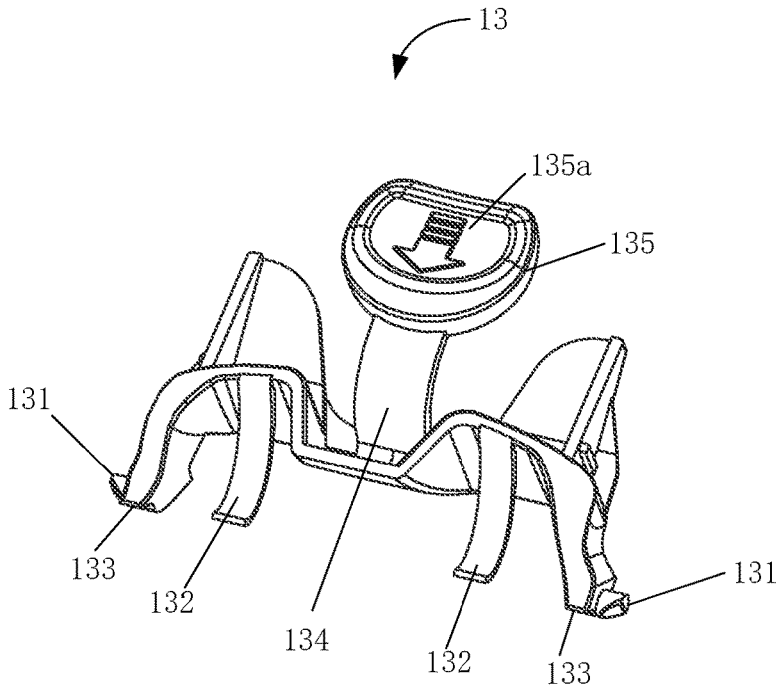
FIG. 11 is a structural schematic diagram of a connecting member according to one embodiment of the present disclosure.

As shown in FIG. 6 and FIG. 12, after the external force applied to the handle 2 is removed, due to an elastic reset effect of the elastic components 132, the free end of each of the elastic components 132 slides to the arc top along one end of the arc bottom of each of the sliding blocks 123.

As another optional mode, as shown in FIGS. 1-11, the handle 2 is generally a S-shaped elongate member. A clamping groove 21 is defined on a front end of the handle 2. A clamping hole 22 is defined on a top of the front end of the handle 2, and the clamping hole 22 is communicated with the clamping groove 21. An elastic member 134 is disposed at one end, distal from the cutter head frame 12, of the connecting member 13. The elastic member 134 and the cutter head frame 12 are integrally formed. The elastic member 134 is slidably inserted into the clamping groove 21. A button 135 is disposed on a distal end of the elastic member 134, and the button 135 is inserted into the clamping hole 22. An arc-shaped groove 23 is defined on one side, distal from a front end of the handle 2, of the clamping hole 22. An inclined surface 135*a* is disposed at one end, close to the arc-shaped groove 23, of the button 135.

When detaching an old cutter head assembly 1, fingers move forward along the arc-shaped groove 23 and press the inclined surface 135*a* of the button 135, so that the button 135 is disengaged from the clamping hole 22, and then the elastic member 134 is pulled out of the clamping groove 21. When installing a new cutter head assembly 1, as long as inserting the elastic member 134 and the button 135 into the clamping groove 21, fitting the button 135 into the clamping hole 22, making the inclined surface 135*a* of the button 135 face the arc-shaped groove 23, and the button 135 and the clamping hole 22 are clamped through an elastic reset structure of the elastic member 134. Therefore, installation and disassembly are very convenient.

Obviously, the person of ordinary skill in the art makes various modifications and variations to the embodiments of the present disclosure without departing from spirit and scope of the embodiments of the present disclosure. Thus, if the modifications and variations of the embodiments of the present disclosure fall within the scope of claims of the present disclosure and equivalent technologies of the claims of the present disclosure, the present disclosure is further intended to include the modifications and variations.

What is claimed is:

1. A back shaver, comprising:

a cutter head assembly; and a handle;

wherein the handle is connected to the cutter head assembly; the cutter head assembly comprises cutter heads, a cutter head frame, and a connecting member; the cutter heads are embedded in a front surface of the cutter head frame, a back surface of the cutter head frame is connected to the connecting member through a rotating shaft; elastic components are disposed on one side, distal from the handle, of the connecting member; sliding blocks are disposed on the back surface of the cutter head frame; when the handle is operated, a first force moment is applied to the cutter head frame through the connecting member, and a free end of each of the elastic components slides along a first end of a corresponding one of the sliding blocks to a second end of the corresponding one of the sliding blocks to generate a second force moment against the first force moment.

2. The back shaver according to claim 1, wherein each of the sliding blocks is an arc-shaped convex block, and each of the sliding blocks comprises a first arc-shaped portion and a second arc-shaped portion, a first end of the first arc-shaped portion is close to an upper edge of the back surface of the cutter head frame, and a second end of the first arc-shaped portion is in a transitional connection with the second arc-shaped portion.

3. The back shaver according to claim 2, wherein the second arc-shaped portion is in an arc-shaped structure, and the arc-shaped structure protrudes towards an outer side of the back surface of the cutter head frame.

4. The back shaver according to claim 2, wherein a number of the sliding blocks is two, and a number of the elastic components corresponding to the sliding blocks is two.

5. The back shaver according to claim 4, wherein each of the elastic components is an elastic sheet and is in an arc-shaped structure.

6. The back shaver according to claim 1, wherein limiting grooves are defined on the back surface of the cutter head frame, limiting stop blocks are disposed on the connecting member, and the limiting stop blocks rotate in the limiting grooves, so that a relative rotation angle of the cutter head frame and the connecting member is not greater than 30°.

7. The back shaver according to claim 6, wherein a number of the limiting grooves is two, and a number of the limiting stop blocks corresponding to the limiting grooves is two.

8. The back shaver according to claim 6, wherein the limiting grooves and the limiting stop blocks are on the same axis.

9. The back shaver according to claim 1, wherein a clamping groove is defined on a front end of the handle; a clamping hole is defined on a top of the front end of the handle, the clamping hole is communicated with the clamping groove; an elastic member is disposed at one end, distal from the cutter head frame, of the connecting member; the elastic member is slidably inserted into the clamping groove; a button is disposed on a distal end of the elastic member, and the button is inserted into the clamping hole.

10. The back shaver according to claim 9, wherein an arc-shaped groove is defined on one side, distal from a front end of the handle, of the clamping hole, and an inclined surface configured to press the button is disposed at one end, close to the arc-shaped groove, of the button.

* * * * *